US007469476B2

(12) United States Patent
Demko

(10) Patent No.: US 7,469,476 B2
(45) **Date of Patent: *Dec. 30, 2008**

(54) LOCKING DEVICE FOR A FOLDING KNIFE

(75) Inventor: Andrew Demko, Wampum, PA (US)

(73) Assignee: Cold Steel, Ventura, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/732,006

(22) Filed: Apr. 3, 2007

(65) Prior Publication Data

US 2008/0040931 A1 Feb. 21, 2008

Related U.S. Application Data

(63) Continuation-in-part of application No. 11/506,937, filed on Aug. 21, 2006.

(51) Int. Cl.
*B26B 3/06* (2006.01)

(52) U.S. Cl. ..... 30/161; 30/160

(58) Field of Classification Search ..... 30/160, 30/161

See application file for complete search history.

(56) References Cited

U.S. PATENT DOCUMENTS

| | | | | | |
|---|---|---|---|---|---|
| 4,347,665 | A * | 9/1982 | Glesser | 30/161 |
| 4,404,748 | A * | 9/1983 | Wiethoff | 30/161 |
| 4,442,600 | A * | 4/1984 | Felix-Dalichow | 30/161 |
| 4,811,486 | A * | 3/1989 | Cunningham | 30/161 |
| 5,093,995 | A | 3/1992 | Jan | |
| 5,461,786 | A * | 10/1995 | Miller | 30/161 |
| 5,685,079 | A | 11/1997 | Brothers et al. | |
| 5,815,927 | A * | 10/1998 | Collins | 30/161 |
| 5,826,340 | A * | 10/1998 | Hull | 30/161 |
| 5,887,347 | A * | 3/1999 | Gibbs | 30/161 |
| 6,145,202 | A * | 11/2000 | Onion | 30/160 |
| 6,378,214 | B1 * | 4/2002 | Onion | 30/161 |
| 6,427,334 | B2 * | 8/2002 | Onion | 30/161 |
| 6,427,335 | B1 * | 8/2002 | Ralph | 30/161 |
| 6,438,848 | B1 * | 8/2002 | McHenry et al. | 30/161 |
| 6,574,869 | B1 * | 6/2003 | McHenry et al. | 30/161 |
| 6,751,868 | B2 | 6/2004 | Glesser | |
| 6,918,184 | B2 | 7/2005 | Glesser | |
| 7,059,053 | B2 * | 6/2006 | Sakai | 30/160 |
| 7,222,429 | B2 * | 5/2007 | PerMar, Jr. | 30/161 |
| 7,293,360 | B2 * | 11/2007 | Steigerwalt et al. | 30/160 |
| 7,340,837 | B1 * | 3/2008 | Busse | 30/153 |
| 2003/0131478 | A1 * | 7/2003 | Feng | 30/160 |
| 2004/0068874 | A1 * | 4/2004 | Chu | 30/161 |
| 2004/0134075 | A1 * | 7/2004 | Chu | 30/161 |
| 2006/0150422 | A1 * | 7/2006 | Grice et al. | 30/160 |
| 2007/0169354 | A1 * | 7/2007 | Ralph | 30/160 |

* cited by examiner

*Primary Examiner*—Kenneth E. Peterson
*Assistant Examiner*—Sean Michalski
(74) *Attorney, Agent, or Firm*—Harpman & Harpman

(57) ABSTRACT

A folding knife having an improved locking mechanism that keeps the knife in an open extended use position until specific close actions are initiated. The improved locking mechanism provides a safety pin that is secured within the frame elements so as to be positioned between the knife blade and the free end of a locking bar that is spring urged thereagainst imparting improved force transfer locking structure thereto with wear adjustably pivot engagement points of the locking mechanism under spring urged locking engagement.

8 Claims, 5 Drawing Sheets

LOCKING DEVICE FOR A FOLDING KNIFE

This is a continuation in part patent application of Ser. No. 11/506,937, filed Aug. 21, 2006.

BACKGROUND OF THE INVENTION

1. Technical Field

This invention relates to folding knives that provide a compact configuration in which the knife blade is pivotally attached to the handle and can be folded therewithin when not in use. Such folding knives have blade engagement locking devices to securely lock and hold the blade in extended longitudinal position with the handle for use. A typical locking element is commonly referred to as a lock bar that extends along the upper back edge of the knife and requires a manual depression at one end to release the free end from direct engagement with a retaining lock notch formed in the blade inwardly from its primary pivot attachment point with the handle frame elements.

2. Description of Prior Art

Prior art folding knives of this type have a variety of blade locking engagement structures to afford a number of blade lock and release positions, see for example U.S. Pat. Nos. 5,093,995, 5,685,079, 6,574,869, 6,751,868, and 6,918,184.

In U.S. Pat. No. 5,093,995 a knife locking mechanism is disclosed that uses a pressable lock pin having a notch therein to be resiliently engaged with a corresponding notch in the blade, locking same in extended use position.

U.S. Pat. No. 5,685,079 claims a locking mechanism for a folding knife in which a lever is movable between two positions using a notched cylinder body to selectively engage a portion of the blade.

U.S. Pat. No. 6,574,869 is directed to a folding pocket knife with a lock having a locking pin that is slidably positioned to engage a shoulder on the blade.

U.S. Pat. No. 6,918,184 discloses a knife with an integral stop pin of a locking mechanism is used to prevent the inadvertent closing of the knife blade as well as over extension of the blade during use.

Finally, in U.S. Pat. No. 6,751,868 a folding knife with a spherical locking mechanism is illustrated having a ball biased by a coil spring. The ball selectively engages a tongue portion on the heel end of the blade preventing the blade from rotation, locking same.

SUMMARY OF THE INVENTION

A locking reinforcement mechanism for a folding knife utilizing a reinforcement pin that transfers the associated load pressure from the lock pivot pin of the lock bar and imparts a safety prevention feature by reducing the possibility of shearing of the lock bar engagement hook portion on the knife blade heretofore associated with the knife lock failure under extreme load induced stress.

DETAILED DESCRIPTION OF THE INVENTION

Figure 1:
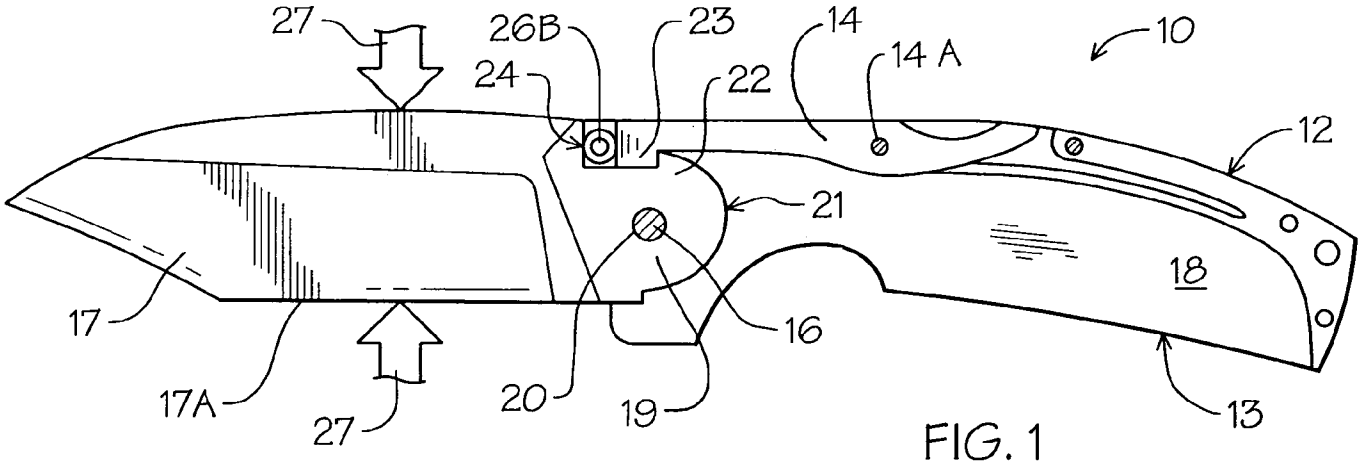
FIG. 1 is a side elevational view of the folding knife in open locked position with the reinforcing pin of the invention.

Referring now to FIG. 1 of the drawings, a folding knife 10 can be seen in unfolded locked position. The knife 10 has a blade portion 11 pivotally secured to a handle support portion 12. The handle support portion 12 has frame members 13 with a pivoted locking bar 14 and interengaging spring element 15. The blade portion 11 is pivotally secured via a hinge pin 16 therethrough as that which is manually deployed for a folding knife configuration. The blade portion 11 defines a blade 17 is accordingly removably disposed within a blade retention slot 18 defined within the handle support portion 12 so that a sharpened edge 17A of the blade 17 is safely enclosed therewithin. The blade 17 has a shank portion 19 which is apertured at 20 through which the hinge pin 16 extends pivotally securing the blade 16 to the handle support portion 12 as hereinbefore described.

Figure 5:
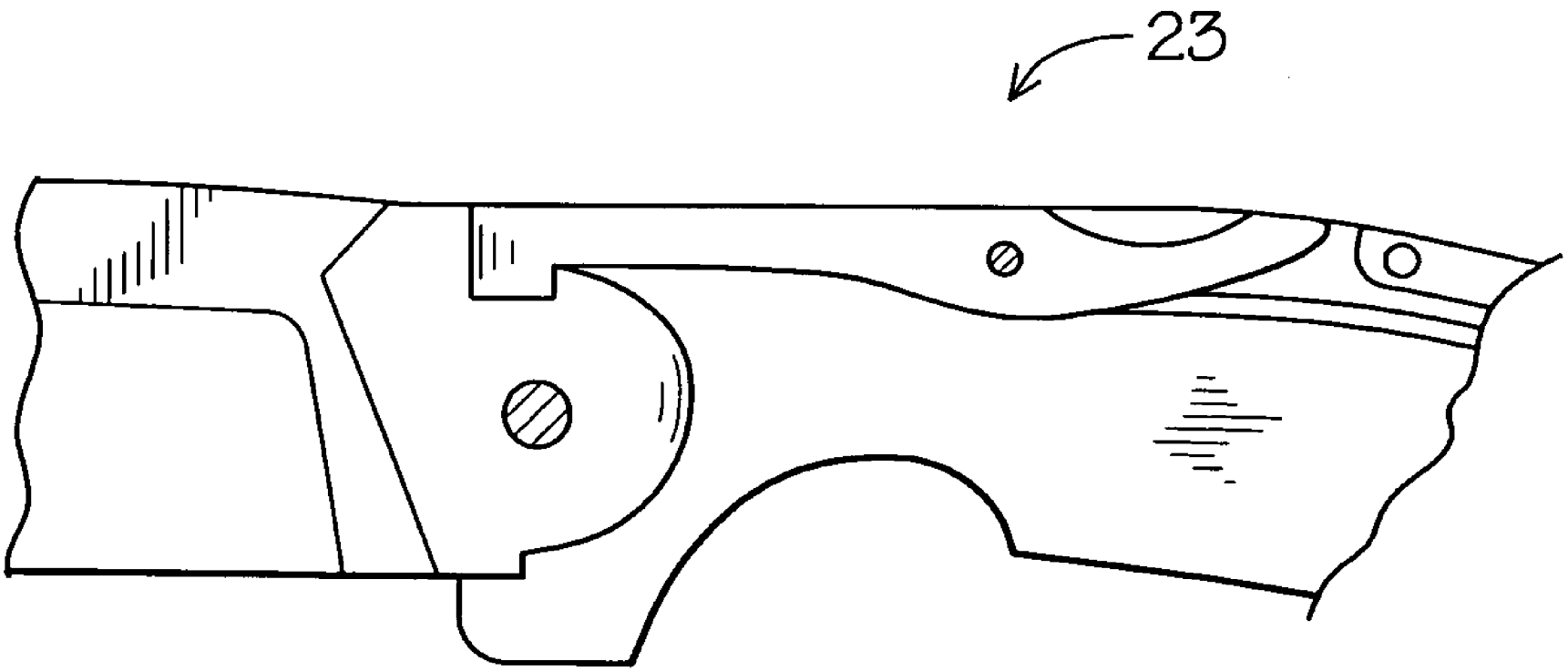
FIG. 5 is a partial side elevational view of a prior art folding knife locking mechanism.

The shank portion 19 has an arcuate end edge 21 that defines at its upper terminus a shank hook 22 formed therein. The locking bar 14 has a correspondingly engageable notched free end portion 23 that is registerably engaged to the shank hook 22 when in unfolded locked position. The hereinbefore described folding knife structure is typical of a prior art knifes 23A illustrated for comparison in FIG. 5 of the drawings.

Figure 2:
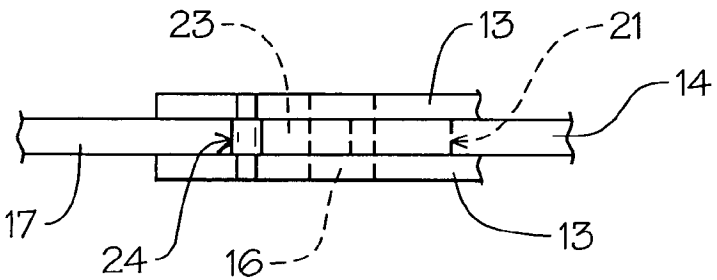
FIG. 2 is an enlarged partial top plan view of the reinforcing pin and adjacent knife elements thereof.
Figure 4:
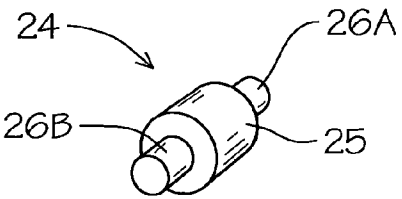
FIG. 4 is an enlarged perspective view of the reinforcing pin of the invention.

The improvement is directed to a safety reinforcement pin 24 of the invention, best seen in FIG. 4 of the drawings, that has a main cylindrical body portion 25 with an integral monolithic oppositely disposed axially aligned cylindrical mounting lugs 26A and 26B extending respectively therefrom. The mounting lugs 26A and 26B are set into the corresponding rail frame elements 13 as best seen in FIG. 2 of the drawings.

Figure 3:
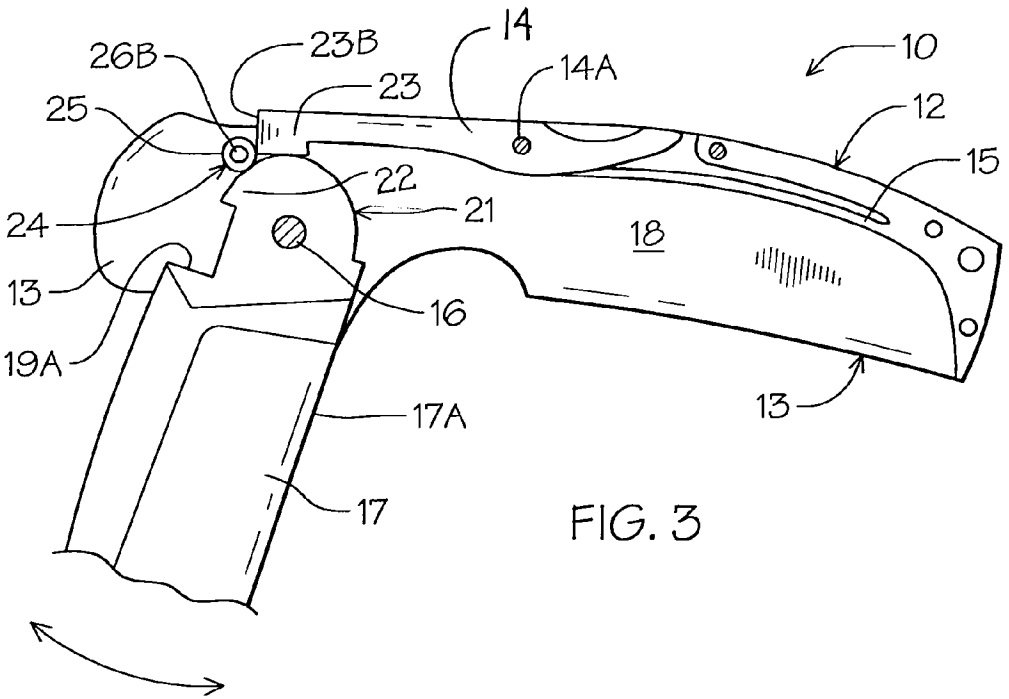
FIG. 3 is a side elevational view of the reinforcing pin equipped knife in unlocked partial folded position.

During the blade 17 deployment from within the handle support portion 12, the blade shank portion 19 arcuate edge 21 will engage the notched end portion 23 of the locking bar 14 which is pivotally deployed via a pivot pin 14A against the resilient spring element 15 as seen in FIG. 3 of the drawings which upon the blade 17 full deployment maintains a locking relationship with the shank hook portion 22 as seen in FIG. 1 of the drawings.

Figure 6:
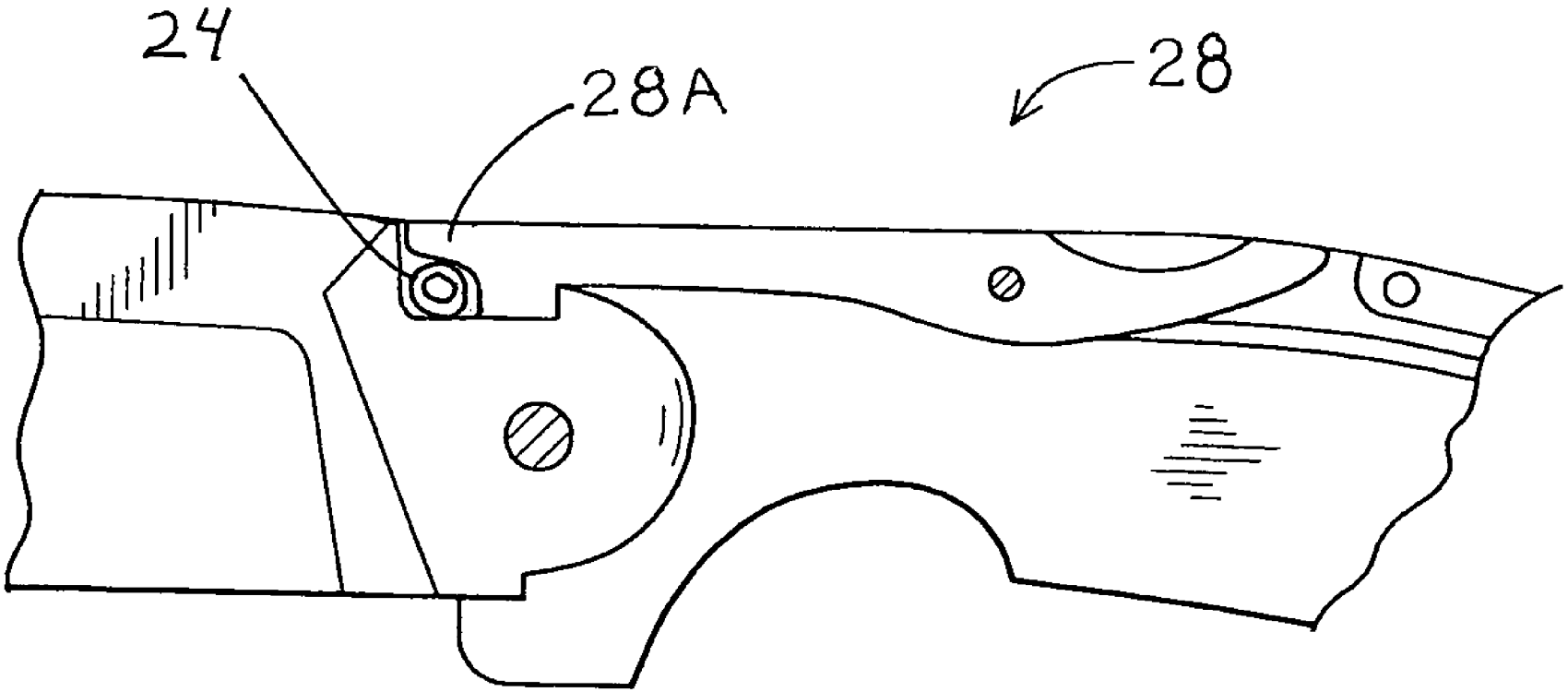
FIG. 6 is a partial side elevational view of an alternate configuration of the invention.

An alternate modified configuration can be seen in FIG. 6 of the drawings in which a knife 28 is illustrated having an extended free end portion 28A that overlies the reinforcement pin 24. This feature hides the pin 24 from view which may be desirable in some applications.

It will be seen therefore that a parallel abutting relationship is defined between a forward edge portion 19A of the shank from the hook 22 with an engagement end surface 23B of the end portion 23 of the locking bar 15 in fully deployed (open position. The reinforcing pin 24 will registerably engage the end surface 23B of the locking bar 14 and under applied to positive or negative pressure indicated by load arrows 27, a load transfer will occur correspondingly relieving the lock bar pivot pin 14A of failure inducing pressure preventing the lock bar portion 23 from shearing off as is previously the case common within the prior art.

Figure 7:
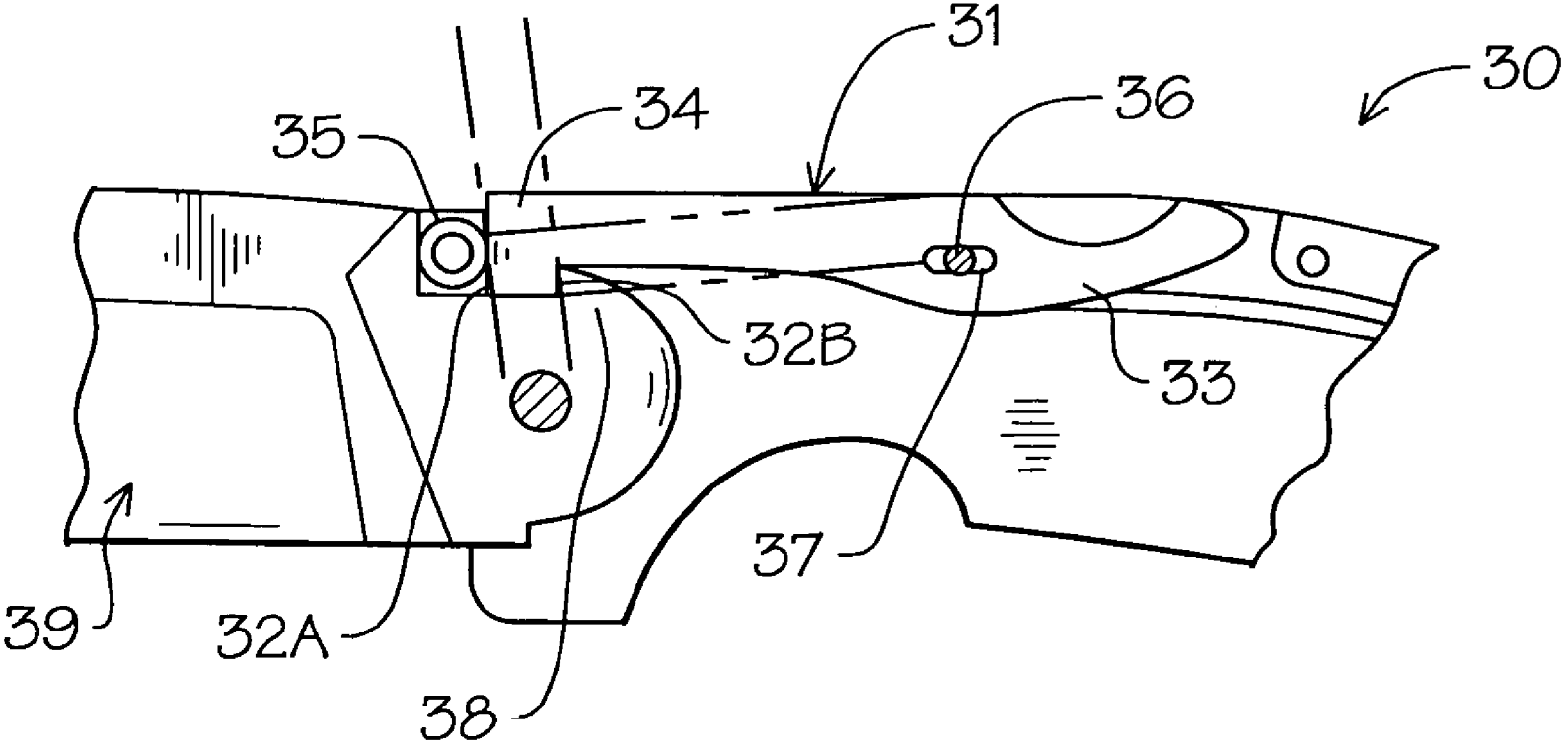
FIG. 7 is a partial side elevational view of a second alternate configuration adjustable lock bar pivot point.

Referring now to FIG. 7 of the drawings, a second alternate form of the invention can be seen at 30 in which a modified lock bar 31 improvement is disclosed having a central body member 32, defining a resilient engagement portion 33 with a shank extending hook portion 34 formed on the oppositely disposed end thereof. The shank extension hook 34 has a safety reinforcing pin engagement surface 32A and a shank hook engagement surface 32B. The safety reinforcement pin engagement surface 32A and the shank hook engagement surface 32B are both of a co-parallel arcuate angular inclination as illustrated. A safety reinforcement pin 35 the same as previously disclosed pin 24 is positioned and used in the same manner to transfer load input indicated by directional arrows to a lock bar pivot pin 36. In this improved alternate form of the invention, an elongated opening at 37 in the lock bar 31 is provided through which the pivot pin 36 extends. This engagement will allow for an effective adjustable "pivot point" relative to the lock bar 31 position on its longitudinal axis. The adjustable "pivot point" will in turn provide for wear compensation of the critical engagement surfaces during long term use keeping the effective engagement surfaces in proper engagement orientation in which the respective angular safety reinforcement pin engagement surface 32A and corresponding angular shank hook engagement surface 32B will effectively maintain the lock bar 31 secure engagement between the safety reinforcement pin 35 and a shank hook 38 extending from the shank maintaining the blade 39 in a secure lock extended open position resistant to bi-lateral force input by transfer to said lock bar pin 36.

It will be seen that with the addition of the safety reinforcement pin 24 and of the invention within a modified folding knife locking assembly as hereinbefore illustrated and described, that an improved and enhanced folding knife 10 has been achieved.

It will thus be seen that a new and novel folding knife configuration of an improved locking mechanism has been illustrated and described and it will be apparent to those skilled in the art that various changes and modifications may be made therein without departing from the spirit of the invention.

Therefore I claim:

1. An improvement to a folding knife comprises, an elongated handle support portion with an elongated knife blade pivotally secured thereto for movement of said blade from a first closed position within said handle to a second locked position extending from said handle, said knife blade having an elongated sharp edge portion and a shank end portion within said handle portion, a spring urged locking bar pivotolly positioned within said handle portion selectively engageable with said shank portion retaining said blade in a locked open position, a cylindrical reinforcement pin registerably positioned between said locking bar and said shank portion of said blade, an elongated slot in said locking bar about a pivot in aligned in longitudinal relation therewithin.

2. The improvement to a folding knife set forth in claim 1 wherein said shank portion having a shank hook surface thereon is registerable with a corresponding notched free end portion on said locking bar.

3. The improvement to a folding knife set forth in claim 1 wherein said cylindrical reinforcement pin is secured within said handle portion by oppositely disposed lugs extending from said cylindrical reinforcement pin.

4. The improvement to a folding knife set forth in claim 2 wherein said cylindrical reinforcement pin is in aligned engaged relation with said blade and locking bar engaged notched free end portion.

5. The improvement to a folding knife set forth in claim 1 wherein said locking bar is pivotally positioned from a first position engaging an arcuate end edge of said shank and said cylindrical reinforcement pin to a second unlocked position engaging said shank.

6. The improvement to a folding knife set forth in claim 1 wherein said adjustability of said locking bar, about said pivot pin is dependent on co-parallel arcuate angular inclination of notched end portion of said locking bar and shank hook surface of said shank portion.

7. The improvement to a folding knife set forth in claim 2 wherein said cylindrical reinforcement pin of the invention in locked blade open position is registerable with said shank in both horizontal and vertical face planes in relation to the longitudinal axis of said blade.

8. The improvement to a folding knife set forth in claim 1 wherein a portion of said locking bar overlies the cylindrical reinforcement pin in.

* * * * *